US006120346A

United States Patent [19]

Wang

[11] Patent Number: 6,120,346

[45] Date of Patent: Sep. 19, 2000

[54] RIBBON GUN WITH REPLACEABLE DECORATED HEAD AND CARTRIDGE

[76] Inventor: Kun-Meng Wang, P.O. Box 82-144, Taipei, Taiwan

[21] Appl. No.: 09/370,197

[22] Filed: Aug. 9, 1999

[51] Int. Cl.[7] ..... A63H 33/30

[52] U.S. Cl. ..... 446/473; 446/475

[58] Field of Search ..... 446/475, 473, 446/73; 221/24, 87, 88, 121, 197, 287

[56] References Cited

U.S. PATENT DOCUMENTS

| | | | |
|---|---|---|---|
| D. 344,109 | 2/1994 | Lin | D21/147 |
| 4,138,048 | 2/1979 | Lemmon | 226/152 |
| 4,575,352 | 3/1986 | Matsuda | 446/376 |
| 5,605,485 | 2/1997 | Spector | 446/72 |
| 5,609,507 | 3/1997 | Spector | 446/72 |

*Primary Examiner*—Sam Rimell
*Assistant Examiner*—Jeffrey D. Carlson
*Attorney, Agent, or Firm*—A & J

[57] ABSTRACT

A ribbon gun with replaceable decorated head and cartridge includes a body portion having one end formed with a cavity and an upper portion formed with a recess, a magazine including a plurality of cartridges each having a plurality of slotted ribs and protruded ribs engageable with the slotted ribs, the magazine being fitted within the cavity, a movable cover having a positioning eye at a top rear portion thereof, a circular neck at an upper front portion thereof, a protuberance extending from a top of the circular neck, and a pivot hole at a lower portion thereof. The movable cover is pivotally connected with the body portion. A decorated head has a circular hole adapted to receive the circular neck and a groove configured to engage with the protuberance.

1 Claim, 5 Drawing Sheets

RIBBON GUN WITH REPLACEABLE DECORATED HEAD AND CARTRIDGE

BACKGROUND OF THE INVENTION

1. Field of the Invention

This invention is related to a ribbon gun with replaceable decorated head and cartridge.

2. Description of the Prior Art

The conventional ribbon gun generally includes a body portion and a barrel, wherein the body portion is composed of two symmetric covers which are joined together by tenons and mortises. The body portion is further provided with a triggering means and an axle seat for receiving a cartridge cylinder. However, the cartridge has to be discarded once fired thereby wasting money and material.

Therefore, it is an object of the present invention to provide an improved ribbon gun which can obviate and mitigate the above-mentioned drawbacks.

SUMMARY OF THE INVENTION

This invention is related to an improved ribbon gun with replaceable decorated head and cartridge.

According to a preferred embodiment of the present invention, a ribbon gun with replaceable decorated head and cartridge includes a body portion having one end formed with a cavity and an upper portion formed with a recess, a cartridge including a plurality of tubular members each having a plurality of slotted ribs and protruded ribs engageable with the slotted ribs, the cartridge being fitted within the cavity, a movable cover having a positioning eye at a top rear portion thereof, a circular neck at an upper front portion thereof, a protuberance extending from a top of the circular neck, and a pivot hole at a lower portion thereof, the movable cover being pivotally connected with the body portion, and a decorated head having a circular hole adapted to receive the circular neck and a groove configured to engage with the protuberance.

It is the primary object of the present invention to provide a ribbon gun the decorated head of which can be easily replaced as desired.

It is another object of the present invention to provide a ribbon gun which is simple in construction and easy in operation.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1A:
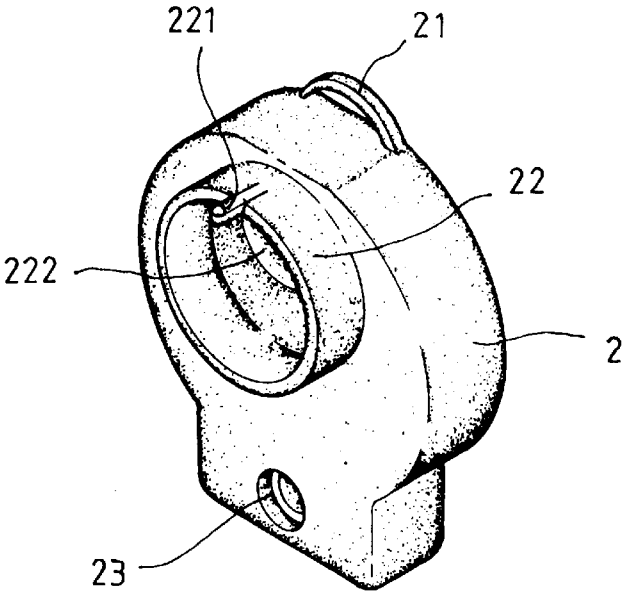
FIG. 1A is a perspective view of the movable cover.
Figure 1:
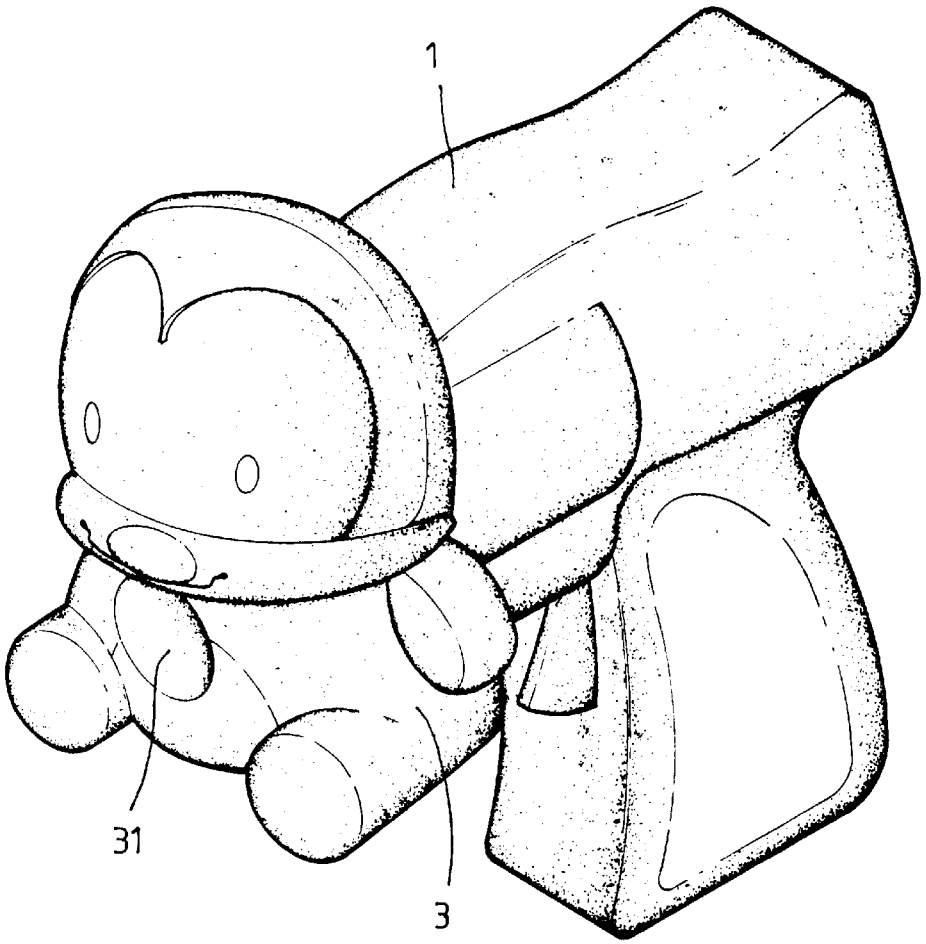
FIG. 1 is a perspective view of the present invention.
Figures 2, 2A:
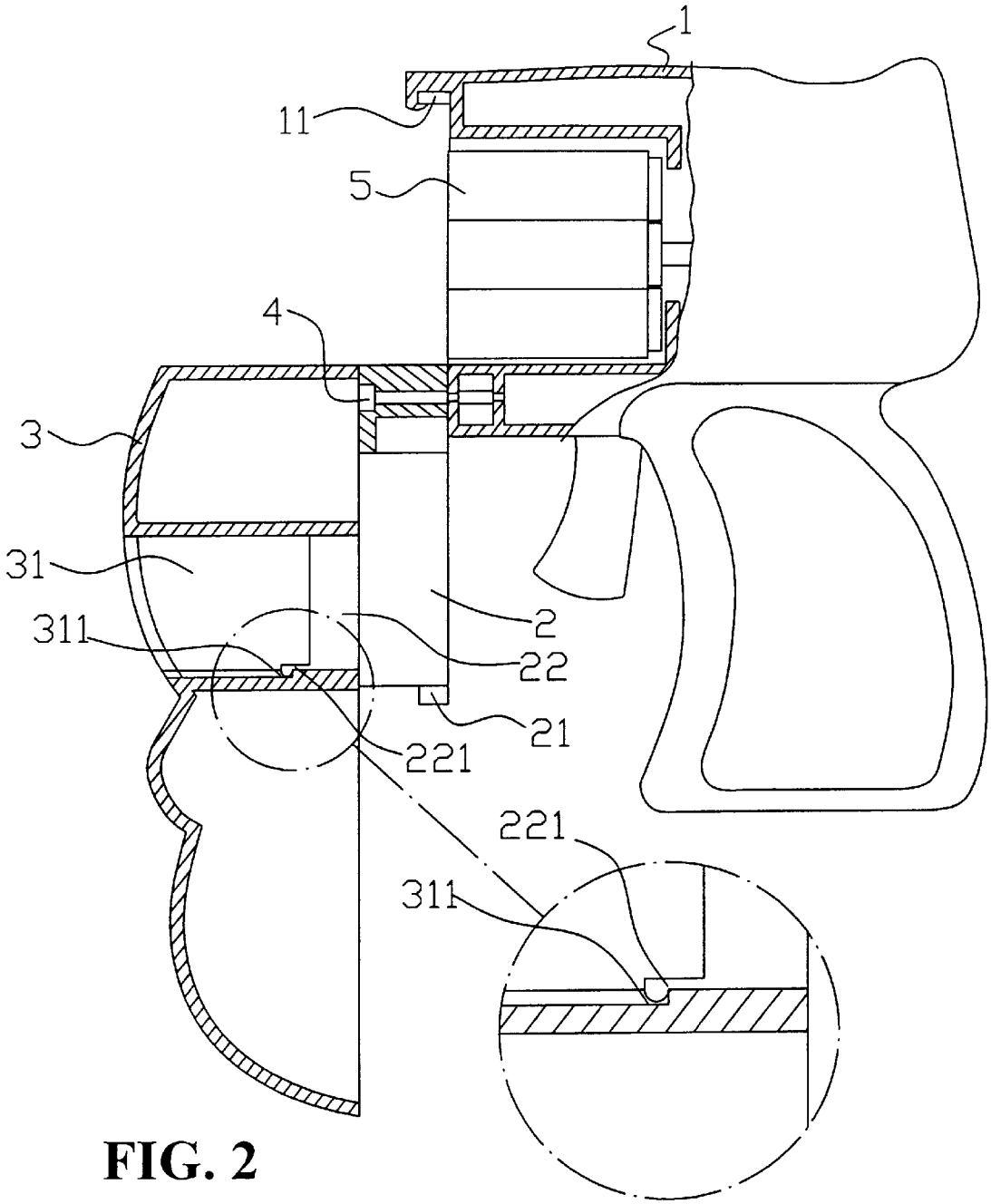
FIG. 2 is a sectional view of the present invention.
FIG. 2A is an enlarged fragmentary view of FIG. 2.
Figure 3C:
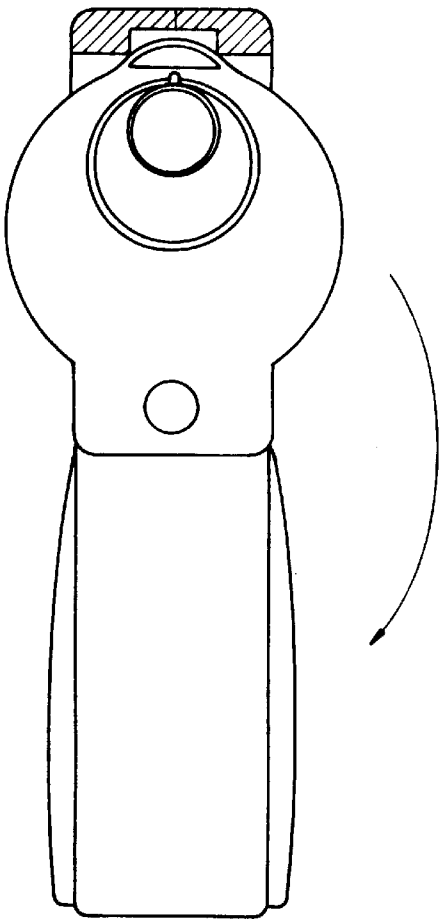
FIGS. 3A, 3B and 3C illustrate the operation of the movable cover.
Figure 3B:
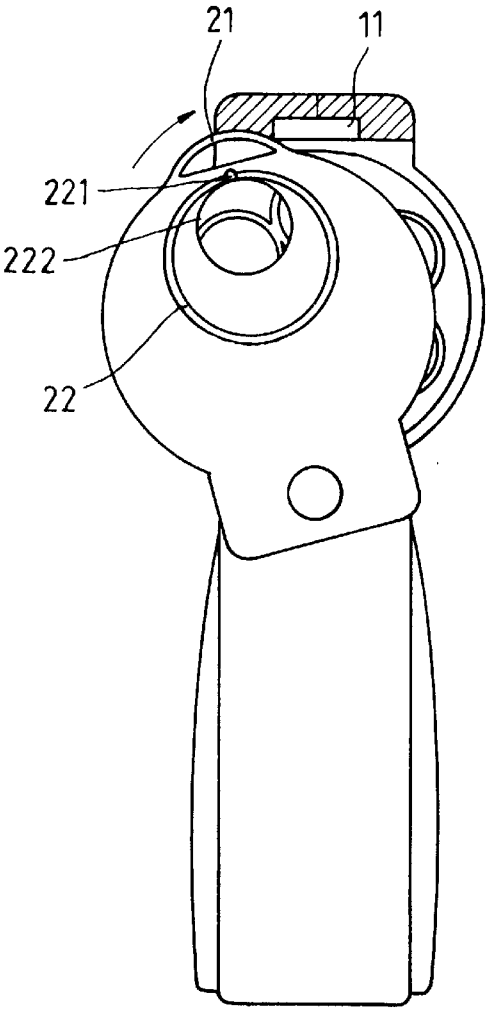
Figure 3A:
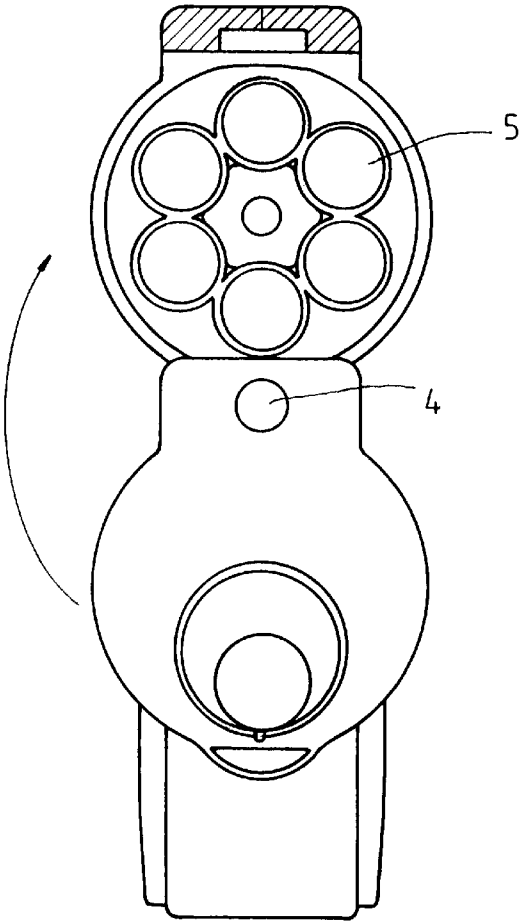

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Referring to FIGS. 1, 1A, 2 and 2A, the ribbon gun according to the present invention generally comprises a body portion 1, a movable cover 2, a decorated head 3, a magazine 5 and a triggering means (not shown).

The movable cover 2 has a positioning eye 21 at its top rear portion, a circular neck 22 at its upper front portion, a protuberance 221 extending from the top of the circular neck 22, and a pivot hole 23 at its lower portion. There are two slits (shown but not numbered) each between one side of the protuberance 221 and the circular neck 22 for increasing the resiliency of the protuberance 221. The circular neck 22 is formed with an opening 222.

The decorated head 3 may be of any desired shape such as a mask and has a circular hole 31 adapted to receive the circular neck 22 of the movable cover 2 and having a groove 311 configured to engage with the protuberance 221 of the movable cover 2.

Figure 4A:
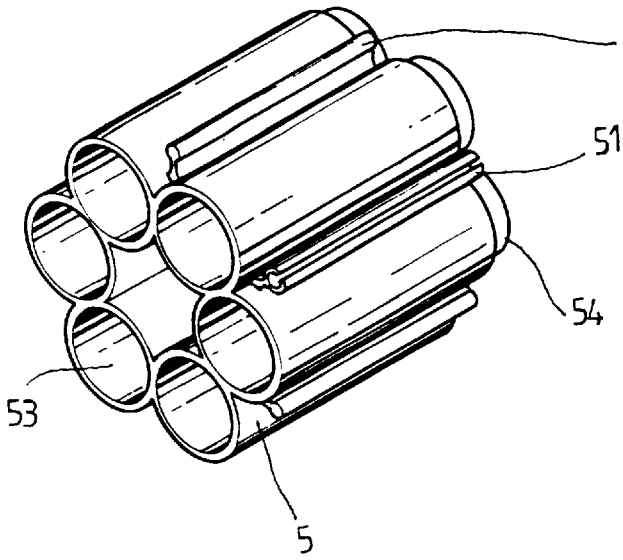
FIG. 4A is a perspective view of the magazine.
Figure 4B:
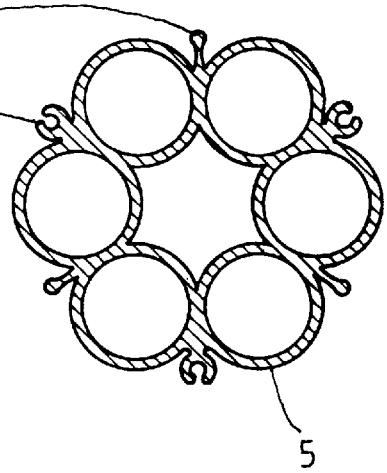
FIG. 4B is a sectional view of the magazine.
Figure 4C:
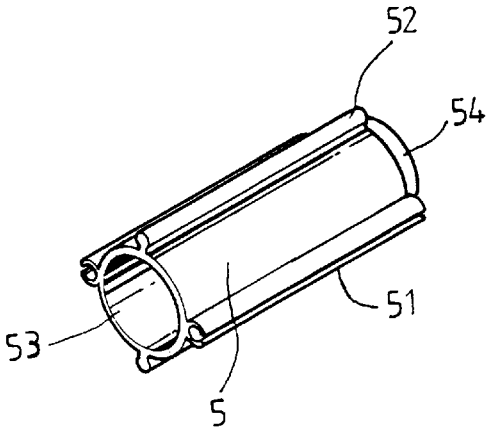
FIG. 4C is a perspective view of the cartridge.

Referring to FIGS. 4A, 4B and 4C, the magazine 5 is composed of a plurality of tubular cartridges 53 each formed with a plurality of slotted ribs 51 and protruded ribs 52 configured to be engageable with the slotted ribs 51. The cartridge 53 has a rear end 54 which is configured to be engageable with the front end of another cartridge 53. The magazine 5 is fitted within an end of the body portion 1.

The triggering means may be of any conventional design well known to the art and is not considered a part of the invention. As the triggering means is actuated, the cartridge 53 in which is mounted a ribbon (not shown) will be pushed out of the magazine 5, the movable cover 2 and the decorated head 3.

The movable cover 2 is pivotally connected with the body portion 1 by a bolt 4 so that the movable cover 2 can be rotated with respect to the body portion 1 for replacing the cartridge 5. The body portion 1 has a recess 11 at the top adapted to engage with the eye 21 of the movable cover 2 thereby enabling the movable cover 2 to keep in place. When the eye 21 is engaged with the recess 11, one of the cartridges 53 of the magazine 5 is aligned with the opening 222 of the movable cover 2 thus enabling a cartridge to go out of the magazine 5 and the movable cover 2. The decorated head 3 has a circular hole 31 adapted to receive the circular neck 22 of the movable cover 2 and having a groove 311 configured to engage with the protuberance 221 of the movable cover 2 so that the movable cover 2 can be engaged with the decorated head 3 and the decorated head 3 can be connected with the body portion 1 thus enabling a cartridge 53 to pass through the movable cover 2 and the decorated head 3.

The decorated head 3 may be easily replaced with another decorated head with a desired shape by disengaging the decorated head 3 from the movable cover 2, thus changing the appearance of the gun and making it become more interesting.

Figures 5A, 5B, 5C, 5D:
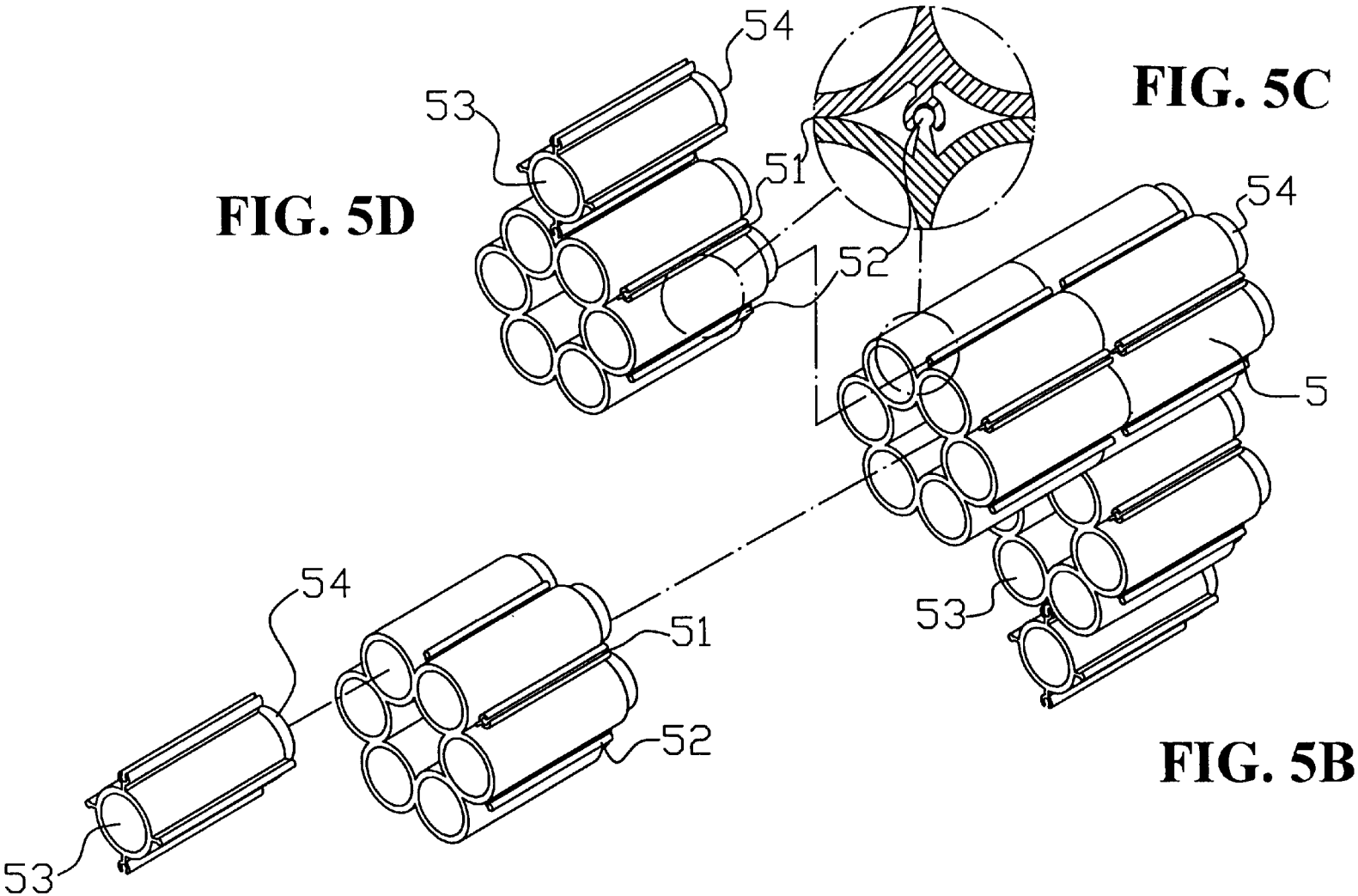
FIGS. 5A, 5B, 5C and 5D illustrate another preferred embodiment of the magazine.

The magazine 5 can be enlarged by engaging with additional cartridges as desired (see in FIGS. 5A, 5B, 5C and SD). As shown, the slotted ribs 51 are engaged with the protruded ribs 52 to join two or more cartridges together.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A ribbon gun with replaceable decorated head and cartridge:

a body portion having one end formed with a recess;

a magazine composed of a plurality of cartridges each having a plurality of slotted ribs and protruded ribs engageable with said slotted ribs, said magazine being fitted within an end of said body portion;

a movable cover having a positioning eye at a top rear portion thereof, a circular neck with a hole going all the way through said cover, a protuberance extending from a top of said circular neck, and a pivot hole at a lower portion thereof, said movable cover being pivotally connected with said body portion; and a decorated head having a circular hole adapted to receive said circular neck and a groove configured to engage with said protuberance.

* * * * *